US011738896B2

(12) United States Patent
Van Triel et al.

(10) Patent No.: US 11,738,896 B2
(45) Date of Patent: Aug. 29, 2023

(54) APPLICATION UNIT, METHOD FOR OPERATING AN APPLICATION UNIT, AND PACKAGING MACHINE HAVING AN APPLICATION UNIT

(71) Applicant: KHS GMBH, Dortmund (DE)

(72) Inventors: Manfred Van Triel, Xanten (DE); Thomas Jöhren, Bocholt (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 18/010,662

(22) PCT Filed: Oct. 4, 2021

(86) PCT No.: PCT/EP2021/077218
§ 371 (c)(1),
(2) Date: Dec. 15, 2022

(87) PCT Pub. No.: WO2022/078787
PCT Pub. Date: Apr. 21, 2022

(65) Prior Publication Data

US 2023/0159201 A1 May 25, 2023

(30) Foreign Application Priority Data

Oct. 13, 2020 (DE) ..... 10 2020 126 782.7

(51) Int. Cl.
*B65B 17/02* (2006.01)
*B65B 49/12* (2006.01)
(Continued)

(52) U.S. Cl.
CPC ..... *B65B 17/025* (2013.01); *B65B 49/12* (2013.01); *B65B 59/001* (2019.05); *B65B 59/04* (2013.01); *B65B 65/02* (2013.01)

(58) Field of Classification Search
CPC ..... B65B 17/025; B65B 17/00; B65B 17/02; B65B 59/001; B65B 49/12; B65B 59/04; B65B 11/004; B65B 11/105; B65B 35/44
See application file for complete search history.

(56) References Cited

U.S. PATENT DOCUMENTS 3,032,944 A * 5/1962 Hull ..... B65B 17/025 53/543
6,170,225 B1 1/2001 Cervantes et al.
(Continued)

FOREIGN PATENT DOCUMENTS

DE 1220323 A 6/1966
DE 69816507 T2 2/2004
(Continued)

*Primary Examiner* — Anna K Kinsaul
*Assistant Examiner* — Veronica Martin
(74) *Attorney, Agent, or Firm* — Laurence A. Greenberg; Werner H. Stemer; Ralph E. Locher

(57) ABSTRACT

An application unit in a packaging machine attaches a material blank to containers in a container group so as to form a multipack. At least one pressing element connect the material blank to the containers while they are conveyed along a transport plane. A drive unit moves the pressing element with a tool plate between out-of-engagement and engagement positions with the containers. The drive unit has mutually parallel and spaced-apart first and second drive disks to be rotated about respective first and second axes of rotation. The first and second axes of rotation are horizontal and located at the same height but not coaxial with each other. The pressing element is articulated to the first drive disk by a first joint axis and to the second drive disk by a second joint axis such that the tool plate is oriented horizontal during rotation of the two drive disks.

18 Claims, 6 Drawing Sheets

(51) Int. Cl.

| | |
|---|---|
| ***B65B 65/02*** | (2006.01) |
| ***B65B 59/04*** | (2006.01) |
| ***B65B 59/00*** | (2006.01) |

(56) References Cited

U.S. PATENT DOCUMENTS

| | | | | |
|---|---|---|---|---|
| 2004/0068961 | A1 | 4/2004 | Chalendar et al. | |
| 2018/0346162 | A1 * | 12/2018 | Rouzer | B65B 17/025 |

FOREIGN PATENT DOCUMENTS

| | | | | |
|---|---|---|---|---|
| EP | 2239200 | A2 | 10/2010 | |
| GB | 132531 | A | 12/1919 | |
| WO | 9629247 | A1 | 9/1996 | |
| WO | WO-9629247 | A1 * | 9/1996 | B65B 17/025 |
| WO | 02060780 | A2 | 8/2002 | |

* cited by examiner

APPLICATION UNIT, METHOD FOR OPERATING AN APPLICATION UNIT, AND PACKAGING MACHINE HAVING AN APPLICATION UNIT

FIELD AND BACKGROUND OF THE INVENTION

The invention relates to an application unit for applying a material blank, in particular for forming a multipack, to containers combined to form a container group, which comprises

- at least one pressing element, comprising a tool plate, for connecting the material blanks to the containers of the container group which are being conveyed along a transport plane, and
- a drive unit, which is designed to move the pressing element in such a way that the tool plate can be moved between an out-of-engagement position and a position of engagement with the containers.

The invention further relates to a method for operating such an application unit and a packaging machine with such an application unit.

Application units for packaging machines for applying and/or pressing a material blank, such a carton section, onto containers which form a group, such as cans or bottles, are known in many different embodiments from the prior art. In the case of application forming a multipack, the material blanks are pressed onto to containers in such a way that the individual material blank is connected in positive fit to the container by way of suitable openings adjusted to the shape of the containers, wherein the material blank is pushed over the container section by section in the region of the openings.

Essential to the function of such application units is the fact that their pressing elements, during the pressing of the material blank to or onto the containers, are guided or held horizontally. The known application units have the disadvantage in this situation that for this purpose they are of a particularly complex structural design, and can only be adapted with a high degree of effort and expenditure to changing production conditions, such as changes in product division arrangements, changes in containers, or the like.

From EP 2 239 200 B1, an application unit is known for producing a carton packaging, which comprises pressing elements secured to a turntable, which form a carton blank which in turn forms the base and the side walls of the carton packaging, and closes it off with a cover. A circulating toothed belt ensures that the pressing elements of the application unit always remain aligned horizontally.

SUMMARY OF THE INVENTION

The invention is based on the object of providing an application unit which can be economically produced and which allows in a simple manner for changing to different production conditions, as well as methods for operating such an application unit, and a packaging machine with such an application unit.

The invention solves the object by means of an application unit with the features as claimed, the methods for operating an application unit or a packaging machine with the features as claimed, and by a packaging machine with the features as claimed. Advantageous further embodiments of the invention are described for the application unit in several dependent claims.

Characterisation features for the application unit according to the invention are that

- the drive unit comprises a first drive disk, which can rotate about a first axis of rotation, and a second drive disk, which is arranged parallel and at a distance from the first drive disk and can rotate about a second axis of rotation, wherein the first and second axes of rotation are aligned horizontally and at the same height, and are not arranged coaxially to one another, and
- the pressing element has a first and a second joint axis, wherein the pressing element is connected, by means of its first joint axis, in an articulated manner to the first drive disk, and by means of its second joint axis to the second drive disk, in such a way that the tool plate is aligned horizontally during a rotation of the two drive disks about the respective axes of rotation.

According to the invention, the drive unit has at least one pressing element, which in turn has a tool plate, wherein the pressing element is connected by means of its first joint axis to the first drive disk, and by means of its second joint axis in an articulated manner to the second drive disk. The connection of the joint axes of the pressing element to the first and second drive disks is preferably configured in such a way that the tool plate arranged at the pressing element, due to an arrangement of the joint axes, is always aligned at the same height during a rotation of the drive disks, wherein a horizontal alignment makes reference to a specific arrangement of the application unit at or in the packaging machine, in which situation the application unit is arranged parallel and at a distance from a transport plane, which as a rule runs horizontally and on which the containers provided with the material blank are moved past the application unit in the transport direction. Advantageously, related to the specified installation location of the application unit, from the arrangement of the jointed axes at the same height, the result is their concurring distance interval from the transport plane during the rotation of the drive disks. The non-coaxial arrangement of the axes of rotation results in a distance interval or offset of the axes of rotation, wherein, related to the specified installation location of the application unit, these are preferably arranged offset behind one another in the transport direction.

A reliable horizontal alignment of the tool plate resulting from this ensures that it guides or holds the material blanks which are to applied onto or at the containers horizontally, such that, in the event of a displacement of the tool plate due to the rotational movement of the drive disks, the material blank is applied to the containers in a reliable manner. In this situation, the application of the material blank takes place during the displacement of the tool plate out of the out-of-engagement position with the containers into the engagement position with the containers, wherein, in the engagement position, the material blanks are placed at or onto the containers as a dependency of the configuration of the engagement position, i.e. of the maximum displacement in the direction onto the containers. If the material blank is applied, a positive fit connection takes place of the material blank and the individual container of the container group, wherein, by means of the material blank, a multipack connection is preferably formed.

The application unit accordingly to the invention is characterised in that it can be produced particularly simply and economically, and allows for a reliable horizontal alignment of the tool plates of the pressing elements. Deviations of the tool plate from the horizontal alignment required for trouble-free operation are effectively pre-empted by the application unit according to the invention. In this situation, by means of the rotation speed of the drive disks about the respective axis of rotation, it is possible in a simple manner for the application unit to be adjusted to the transport speed of the containers. With the aid of the application unit, it is possible to provide the containers with a material blank in a continuous process.

The container group can consist, for example, of 4, 6 or 8 containers, wherein these are grouped preferably in a 2×2 arrangement, a 3×2 arrangement, or a 4×2 arrangement.

The containers of the container group are preferably beverage containers or containers for fluid foodstuffs. The containers can be configured, for example, as cans or bottles.

In principle the specific configuration of the material blanks is freely selectable. To the purpose, the respective material blank has several holes, through which the containers can be guided, in particular their upper sections. Provision can be made at the circumference of the holes for fixing elements in the form of teeth, configured so as to be capable of being inclined in relation to a base surface of the material blank, to provide a positive fit connection to the containers. For particular preference, the material blanks consist of board, in particular corrugated board, or of cardboard. Optionally, the respective material blank can comprise several folding tabs. In the folded state, the folding tabs advantageously form a cover for the upper section of the containers, for example to provide protection against dirt contamination.

The configuration of the connection of the pressing element with the tool plate is in principle freely selectable. According to one particularly advantageous embodiment of the invention provision is made for the pressing element to be configured for a releasable arrangement of the tool plate. This embodiment of the invention makes it possible for the application unit to be adjusted in a particularly simple manner to changing production conditions, such as, for example, the size of the container groups, the size of the containers, the product division, or the like. In the event of a format change, all that is required is for the tool plate required for the processing to be arranged at the pressing element, which, in the event of another format change, can again be replaced in a simple manner. Downtimes due to a rearrangement of the application unit to changing formats can therefore be reduced in a particularly effective manner. The term "product division" is to be understood in the present context as the centre-to-centre distance between two sequential container groups following one another in the transport direction.

The arrangement of the pressing elements at the first and second drive disks can in principle be designed in any desired manner. Accordingly, the possibility is provided of the pressing element or several pressing elements to be secured firmly to the drive disks, wherein an adjustment to changing product divisions of the containers, for example, can take place by a simple change to the circumferential speed of the pressing elements resulting from the speed of rotation of the drive disk.

According to one advantageous embodiment of the invention, however, provision is made for the first and second drive disks to have receiver openings for the detachable arrangement of the articulation axles of the pressing element. The detachable arrangement of the articulation axles allows for the pressing elements to be replaced in a simple manner if the need arises, wherein, as a result, both inspection and maintenance work is made easier.

The arrangement provided for in a particularly advantageous manner of several receiver openings at each of the drive disks, wherein the receiver openings are arranged at the drive disks distributed over their circumference in such a way that several pressing elements can be secured to the drive disks, further allows for the application unit to be provided with several pressing elements, wherein the number and arrangement of the pressing elements can then be selected as a dependency of the product divisions of the containers, wherein, for particular preference, an arrangement of the receiver openings is provided for which allows for an adjustment of the application unit to the product divisions of 160 mm, 240 mm, and/or 320 mm.

This embodiment of the invention therefore makes it possible, by a simple rearrangement capability of the pressing elements, for the application unit to be adjusted to different product divisions, without an adjustment being necessary of the circumferential speed of the pressing elements by way of regulation of the revolution speed of the drive disks. The circumferential speed of the pressing elements can permanently correspond to the production speed of the packaging machine, such that it is possible to do without different speed profiles for drive motors or the like.

Particularly advantageously, provision is made in this situation for each of the drive disks to have several receiver openings, preferably at least eight, which are arranged on a circular path with a predetermined circumference, in particular a circumference of 960 mm. The receiver openings are in this situation divided into a first group with n receiver openings arranged equidistant from one another, a second group with n receiver openings arranged equidistant from one another, which are arranged opposite the receiver openings of the first group, and two individual receiver openings arranged respectively in the middle between the two groups, which are arranged on a common circular path, wherein n is a natural number and is preferably greater than or equal to 3.

In order to adjust the application unit to a changed product division, it is further possible for the two drive disks to be replaced by other drive disks, in which the receiver openings for the pressing elements are arranged on a circular path with a lesser or greater circumference.

In a particularly advantageous manner, provision is made for the application unit to comprise preferably three, four, or six pressing elements, each comprising a tool plate, of which first articulation axles are connected to the first drive disk, and of which second articulation axles are connected to the second drive disk.

The corresponding pressing elements allow in particular for a reliable arrangement of the material blanks to the containers assembled to form four-unit, six-unit, or eight-unit groups, which, for example, have a diameter of 58 or 66 mm, when the pressing elements are arranged on a circular path configured with a preferable circumference of 960 mm. In this situation, for example, the restriction can apply that, during the processing of eight containers assembled to form a group, and a circumference of 960 mm, as well as three tools arranged distributed uniformly over the circumference, as a rule only containers with a diameter of 58 mm can be processed.

In principle, the arrangement of the pressing elements is freely selectable, wherein, according to a particularly advantageous embodiment, provision is made for these to be arranged equidistant from one another, in order thereby to ensure reliable application of the material blanks in a continuously running production process with a constant product division.

The drive of the drive disks can in principle be provided in any desired manner. According to one particularly advantageous embodiment of the invention, however, provision is made for the drive unit to comprise a drive motor, preferably an electric motor, for particular preference a servomotor, for driving the drive disks. The use of a drive motor, in particular an electric motor or servomotor, allows for the revolution speed of the drive disks, and therefore the circumferential speed of the pressing elements, to be determined particularly exactly and precisely, such that an optimum adjustment to the transport speed to the containers being processed can be achieved.

For particular preference, provision is made in this situation for the drive disks, torsionally-resistant, to comprise drive tooth wheels which can be brought into engagement with power takeoff tooth wheels of the drive motor, as a result of which a particularly reliable drive of the drive disks can be ensured. In addition to this, the use of power takeoff and drive tooth wheels allows, by means of stepping up and stepping down, for the drive motor to be operated in an optimum revolution speed range.

The object on which the invention is based is further solved by a packaging machine with an application unit represented heretofore in accordance with the invention or further developed. The packaging machine according to the invention is a device for providing the material blanks to the containers, which, in addition to the application unit, further comprises a feed unit for the material blanks, and a transport device for moving the containers which are to be provided with the material blanks along the application unit. The packaging machine according to the invention is characterised in this situation by the fact that, due to the simple and compactly designed application unit, the packaging machine can be manufactured particularly easily and economically. The continually working application unit ensures in this situation a uniform product flow, as a result of which the packaging machine can be easily integrated into existing and future production processes.

According to one particularly advantageous embodiment of the invention, the transport device for conveying the containers in the transport direction along a transport plane is arranged opposite the packaging machine in such a way that the two axes of rotation of the application unit are aligned perpendicular to the transport direction and arranged at an equal distance interval to the transport plane and offset to one another in the transport direction. According to this embodiment of the invention, due to the arrangement of the application unit provided for, the tool plates of the pressing elements are aligned parallel to the transport plane, as a result of which particularly reliable and simple guiding and holding of the material blanks, and their subsequent application to the containers, are ensured.

It is further advantageous if the application unit is mounted in such a way that its height position can be changed. This allows in particular for the processing of containers of different heights in the packaging machine.

With one advantageous embodiment variant, the packaging machine comprises a further application unit. To the purpose, the further application unit is arranged in the transport direction downstream of the first application unit. Advantageously, the first application unit is configured for the application of a material blank, in particular for the application such as to form a multipack, to containers which are being assembled to form a container group, while the further application unit is configured for the locking of two lateral folding tabs of the material blank applied to the containers.

The first and further application units can essentially be of the same design as each other, but with the difference that the further application unit advantageously comprises, on the under side of the tool plate or instead of the tool plate, a locking element for locking the lateral folding tabs. This locking element can exhibit, for example, a shape which tapers downwards to a tip.

Preferably arranged between the first application unit and the further application unit is a folding device for folding or laying over the lateral folding tabs of the material blank.

To solve the object on which the invention is based, as described heretofore, a method according to the invention for operating an application unit or a packaging machine makes provision, in the manner according to the invention or further developed, that the containers are first conveyed with a first product division, and the product division is then changed, such that the containers are then conveyed with a second product division, which is different from the first product division, wherein, regardless of the product division, a fixed number of pressing elements are used, and their position at the drive disks is left unchanged.

According to the method according to the invention, the application unit comprises a fixed number of pressing elements, the position of which on the drive disks cannot be changed, such that there is no need for a rearrangement of the application unit in the event of a change in the product division, which allows for the method to be carried out particularly easily and economically, wherein the pressing elements are in this case configured in such a way that they can be used with several product divisions.

According to one particularly advantageous embodiment of the method, provision is made that, with the respective specified product division, the circumferential speed of the pressing elements is variable. A change in the circumferential speed by a change in the revolution speed of the drive disks allows for the application unit to be adjusted in a special manner to changing product divisions, as a result of which the flexibility of the method is increased in a particularly advantageous manner.

According to an alternative method according to the invention for operating an application unit or a packaging machine, as represented in the manner according to the invention or a further development, provision is made for the containers to be initially conveyed with a first product division, and then the product division is changed, such that the containers are conveyed with a second product division, which is different from the first product division, wherein, at the change of the product division, the number of the pressing elements and/or their position at the drive disks is changed.

According to this method, provision is made that, as a dependency of the product division, changes are carried out at the application unit with which the pressing elements are changed in their position and/or number, and in this way are adjusted to the changed product division. This method according to the invention allows for a simple adjustment to different product divisions while using an application unit which remains the same, and which can be adjusted to the changed product division by a simple adjustment of the number or position of the pressing elements.

Particularly advantageously, provision is made in this situation that, with the product division specified in each case, the circumferential speed of the pressing elements is constant, i.e. with the respective product division the circumferential speed does not vary in time, wherein the circumferential speed corresponds to the transport speed of the containers. According to this configuration, the circumferential speed advantageously corresponds to the transport speed of the containers, such that an optimum interaction is ensured of the tool plates arranged at the pressing elements with the material blanks which are to be arranged at the containers.

Exemplary embodiments are explained hereinafter with reference to the drawings. These show:

DETAILED DESCRIPTION OF THE INVENTION

Figure 1:
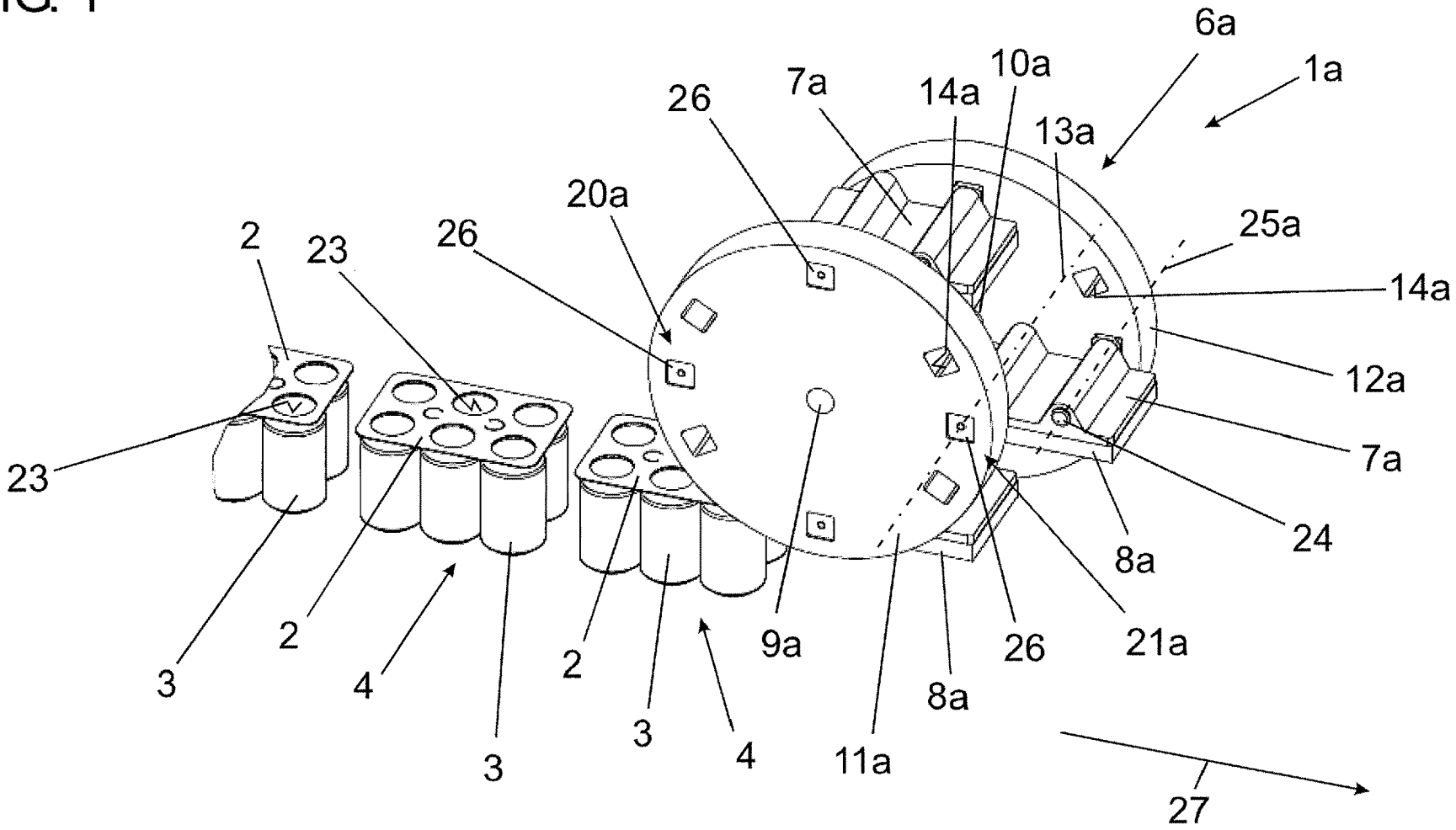
FIG. 1 In a schematic representation, a perspective view of an application unit and several grouped containers.

FIG. 1 shows a first embodiment of an application unit 1*a* in its position relative to several container groups 4, assembled from containers 3, in a packaging machine, not represented here, which comprises a transport device.

The application unit 1*a* comprises four pressing elements 7*a*. The application unit 1*a* further comprises, to drive the pressing element 7*a*, a drive unit 6*a* with a first drive disk 11*a* and a second drive disk 12*a*. The drive disks 11*a*, 12*a* are arranged transverse to the transport direction 27 of the containers 3, parallel and at a distance from one another. The first drive disk 11*a* rotates about its first axis of rotation 9*a*, and the second drive disk 12*a* rotates about its second axis of rotation 10*a*, wherein the first axis of rotation 9*a* and the second axis of rotation 10*a*, viewed in the transport direction, are arranged behind one another and at a distance from one another, wherein the height of the first and second axes of rotation 9*a*, 10*a*, is the same, i.e. their distance from a transport plane of the containers 3.

The drive unit 6*a* comprising the two drive disks 11*a*, 12*a*, serves to adjust the pressing elements 7*a*, provided with tool plates 8*a*, which are arranged in the region between the first drive disk 11*a* and the second drive disk 12*a*. The pressing elements 7*a* are in this situation each connected by means of a first articulated axle 13*a* to the first drive disk 11*a*, and by means of a second articulated axle 25*a* to the second drive disk 12*a*. For the arranging of the pressing elements 7*a* at the first and second drive disks 11*a*, 12*a*, use is made in this situation of jointed bolts 24, mounted in a rotational articulated manner in the pressing elements 7*a*, which are arranged with their ends opposite the free ends over square elements 26 in the first and second drive disks 11*a*, 12*a*. If the receiver openings 14*a*, unlike the exemplary embodiment from FIG. 1, do not have a square shape, then use is preferably made, instead of the square elements 26, of connecting elements of a different shape, such as circular.

The arrangement of the pressing elements 7*a* in the first and second drive disks 11*a*, 12*a* is configured in this situation in such a way that the first articulated axle 13*a* and second articulated axle 25*a* in each case of a pressing element 7*a* always exhibit in common the same distance interval from the transport plane, such that the pressing elements 7*a* and the tool plates 8*a* arranged at the pressing elements 7*a*, during the rotation of the drive disks 11*a*, 12*a*, are always arranged horizontal, i.e. parallel to the transport plane and parallel to the containers 3 arranged in a container group 4.

The pressing elements 7*a* are in this case arranged distributed uniformly over the circumference at the first drive disk 11*a* and the second drive disk 12*a*, wherein the first drive disk 11*a* and the second drive disk 12*a* each comprise a first receiver opening group 20*a* and a second receiver opening group 21*a*. Each of these receiver groups 20*a*, 21*a*, comprises three receiver openings 14*a* arranged distributed over the circumference, equidistant from one another. Two further receiver openings 14*a* are arranged in each case in the middle between the first receiver opening group 20*a* and the second receiver opening group 21*a* on the circular path on which the receiver openings 14*a* of the first and second receiver opening group 20*a*, 21*a* are arranged opposite one another at the drive disks 11*a*, 11*b*.

By means of a drive of the application unit 1*a*, the first and second drive disks 11*a*, 12*a* are set in rotation about their first and second axes of rotation 9*a*, 10*a*, as a result of which the pressing elements 7*a* run with their tool plates 8*a* about the first and second axes of rotation 9*a*, 10*a*. In this situation, the tool plates 8*a* come into engagement with the containers 3 assembled to form container groups 4, and displace the material blanks 2, arranged on the container groups 4—in this situation preferably cardboard blanks—in the direction onto the containers 3.

Figure 2:
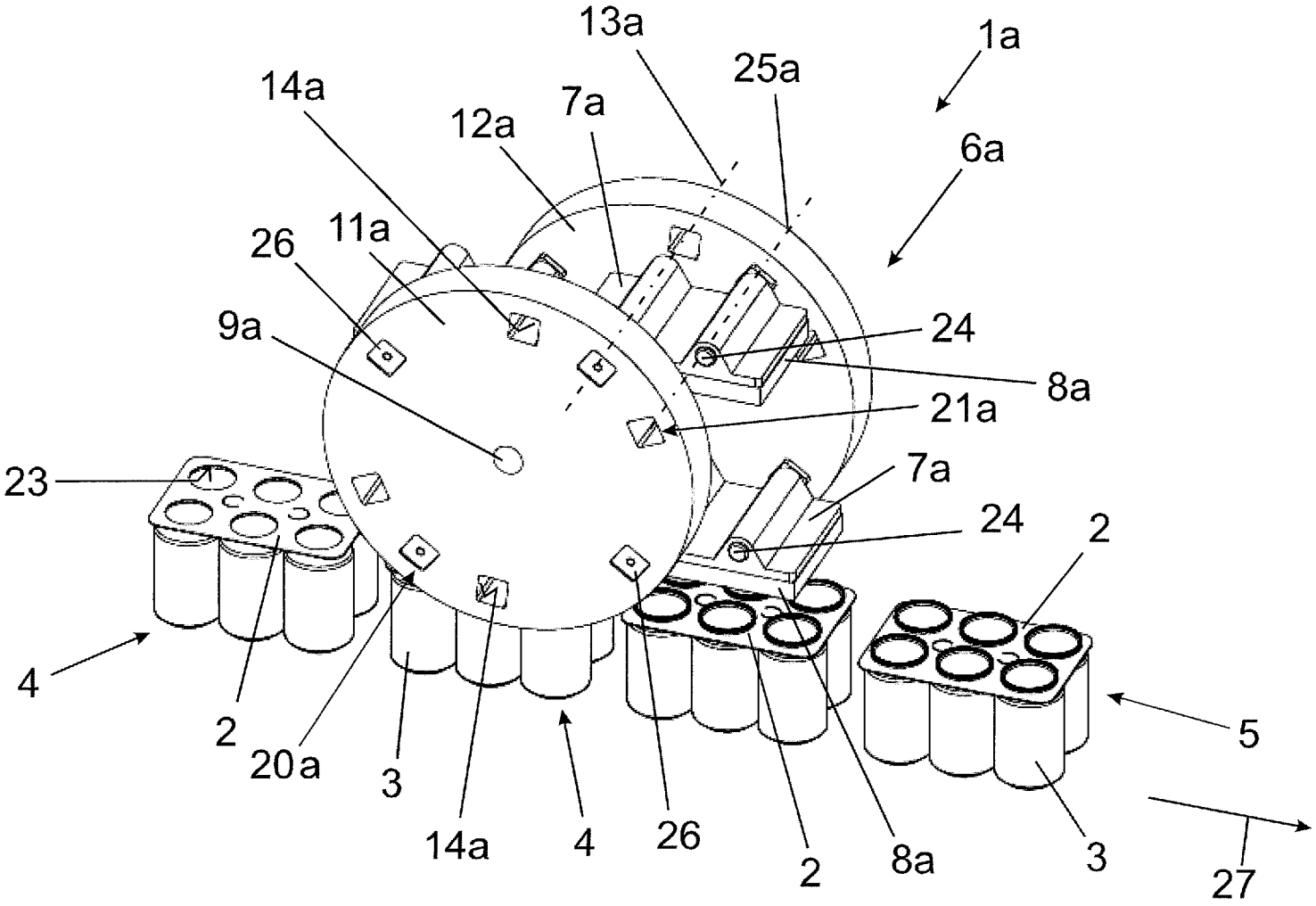
FIG. 2 a perspective representation of the application unit from FIG. 1 in interaction with the grouped containers.

When the container groups 4 are guided along at the application unit 1*a*, along the transport direction 27, then, in interaction with the tool plates 8*a*, the material blanks 2 are moved out of their position represented in FIG. 1, laid on the container groups 4, in order to form bundles 5, into the position represented in FIG. 2, in the transport direction 27 following the application unit, in which the material blanks 2 with holes 23 are arranged over the upper side of the containers 3, such that the holes 23 are arranged in the region of the upper sides of the containers 3 coaxially to the containers 3. During the interaction with the container groups 4, the tool plates 8*a* guide the material blanks 2 and hold them parallel to the upper sides of the containers 3 and move them out of an out-of-engagement position into a position of engagement with the container groups 4.

Figure 3:
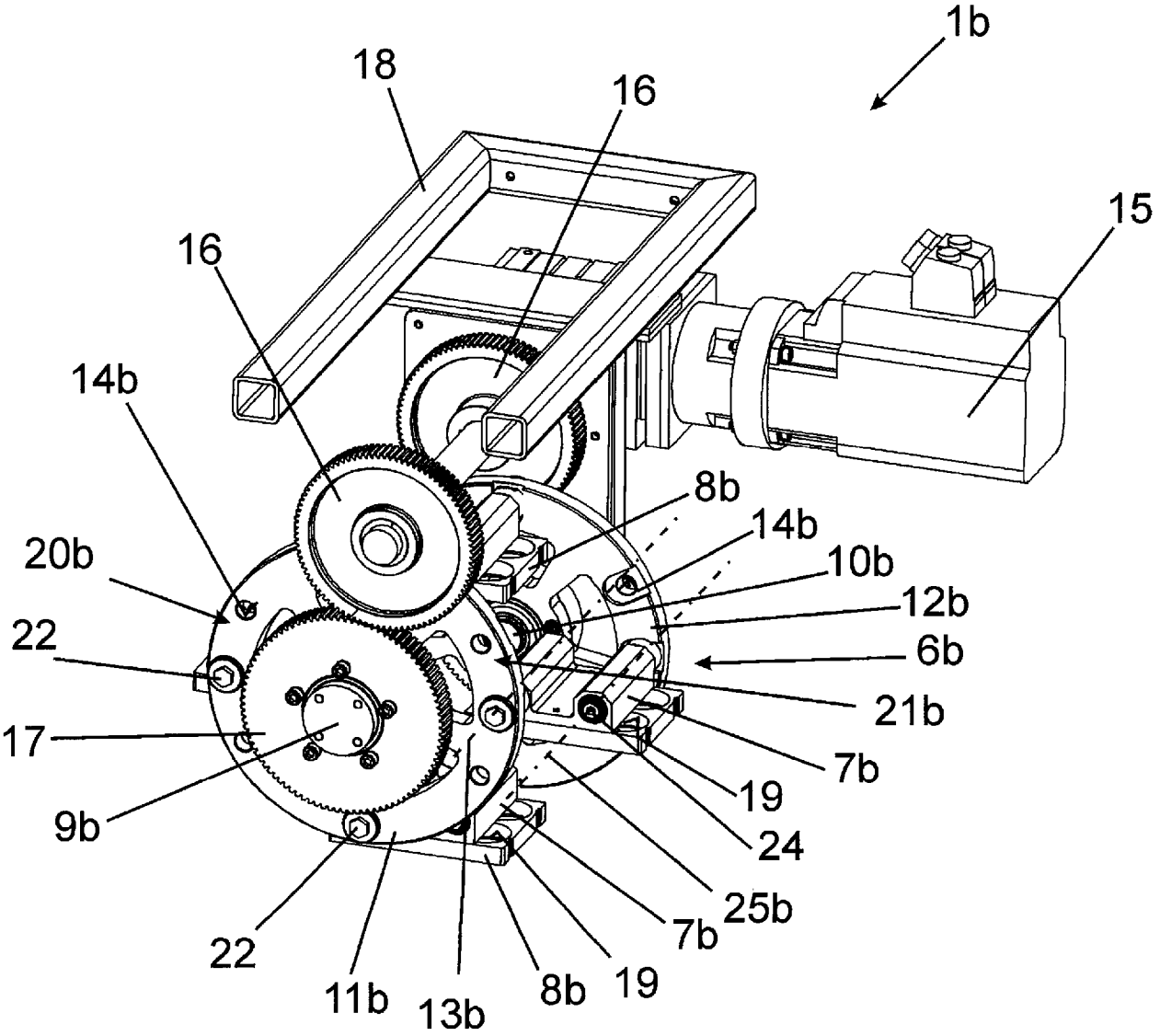
FIG. 3 a perspective representation of a second embodiment of an application unit.

A further embodiment of an application unit 1*b* is reproduced in FIG. 3 in a perspective reproduction. As a departure from the application unit 1*a* represented in FIG. 1 and FIG. 2, the drive unit 6*b* of the application unit 1*b* comprises two wheel-shaped drive disks 11*b*, 12*b*, wherein the first drive disk 11*b* can be rotated about the first axis of rotation 9*b*, and the second drive disk 12*b* can be rotated about the second axis of rotation 10*b*. For the articulated arrangement of the pressing elements 7*b* at the first drive disk 11*b* and of the second drive disk 12*b*, screws 22 are used, with which the jointed bolts 24 extending through the pressing elements 7*b* are connected in a jointed manner to the first and second drive disks 11*b*, 12*b*. The jointed bolts 24 form the first and second articulated axle 13*b*, 25*b* of the pressing elements 7*b*.

As a departure from the embodiment of the receiver openings 14*a* of the drive unit 6*a*, represented in FIGS. 1 and 2, the first and second drive disks 11*b*, 12*b* of the application unit 1*b* represented in FIG. 3 comprise circular receiver openings 14*b*, through which the screws 22 extend. By analogy with the exemplary embodiment represented in FIG. 1 and FIG. 2, the first drive disk 11*b* and the second drive disk 12*b* comprise a first receiver opening group 20*b* and a second receiver opening group 21*b*, which are arranged opposite one another. Arranged between the two receiver opening groups 20*b*, 21*b*, on the circular path of the receiver opening 14*b* are two individual receiver openings 14*b*, in each case in the middle between the two receive opening groups 20*b*, 21*b*.

The drive of the drive unit 6*b* is provided by means of a drive motor 15, arranged on a frame 18, the rotational movement of which is transferred by means of two power takeoff toothed wheels 16 onto drive toothed wheels 17, which are connected to the drive disks 11*b*, 12*b* in a torsionally resistant manner. By means of the drive, the first and second drive disks 11*b*, 12*b* are set in rotation about their first and second axes of rotation 9*b*, 10*b* respectively, wherein the pressing elements 7*b*, with their tool plates 8*b* arranged on them constantly aligned horizontally, circulate in accordance with the direction of the rotation of the first and second drive disks 11*b*, 12*b*. The tool plate 8*b* comprises in this situation openings 19, which are adjusted to the containers 3 of the container groups 4 which are to be processed, and allows for a displacement of the material blank 2 in the direction of the containers 3, as a result of which the multipacks 5 are formed.

Figure 4:
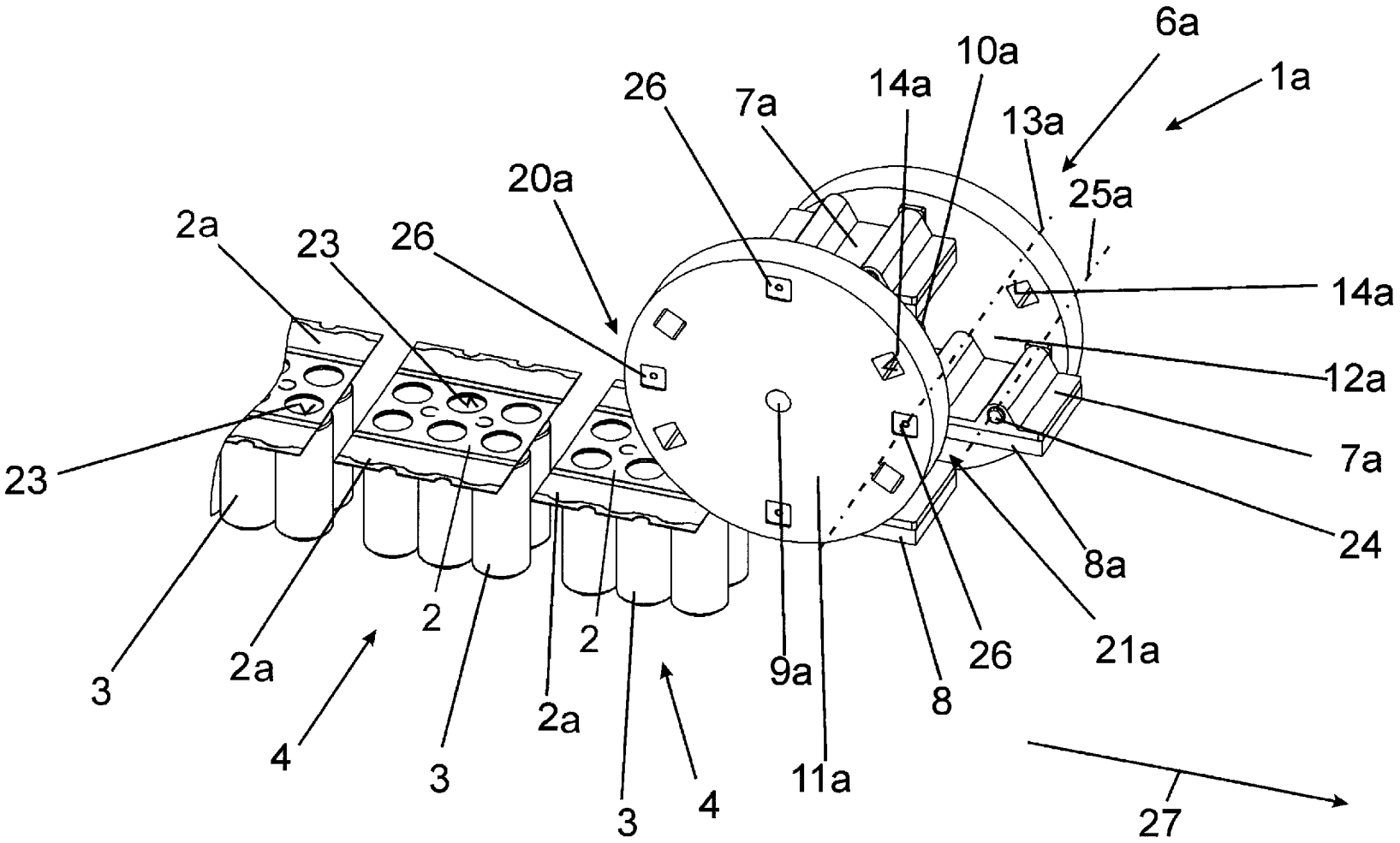
FIGS. 4 & 5 a perspective view of the application unit from FIGS. 1 and 2 during the processing of a material blank with folding tabs.
Figure 5:
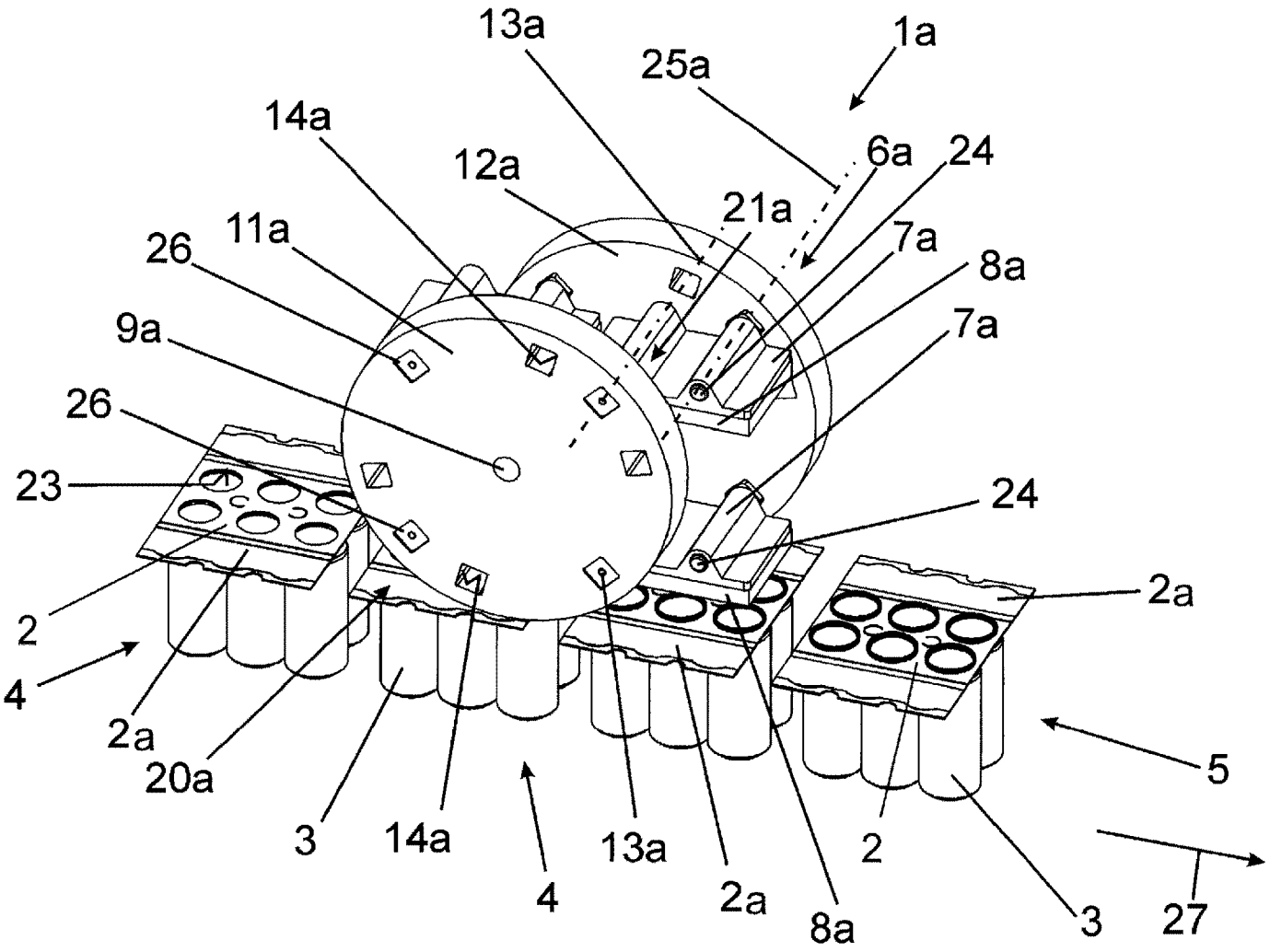
Figure 6:
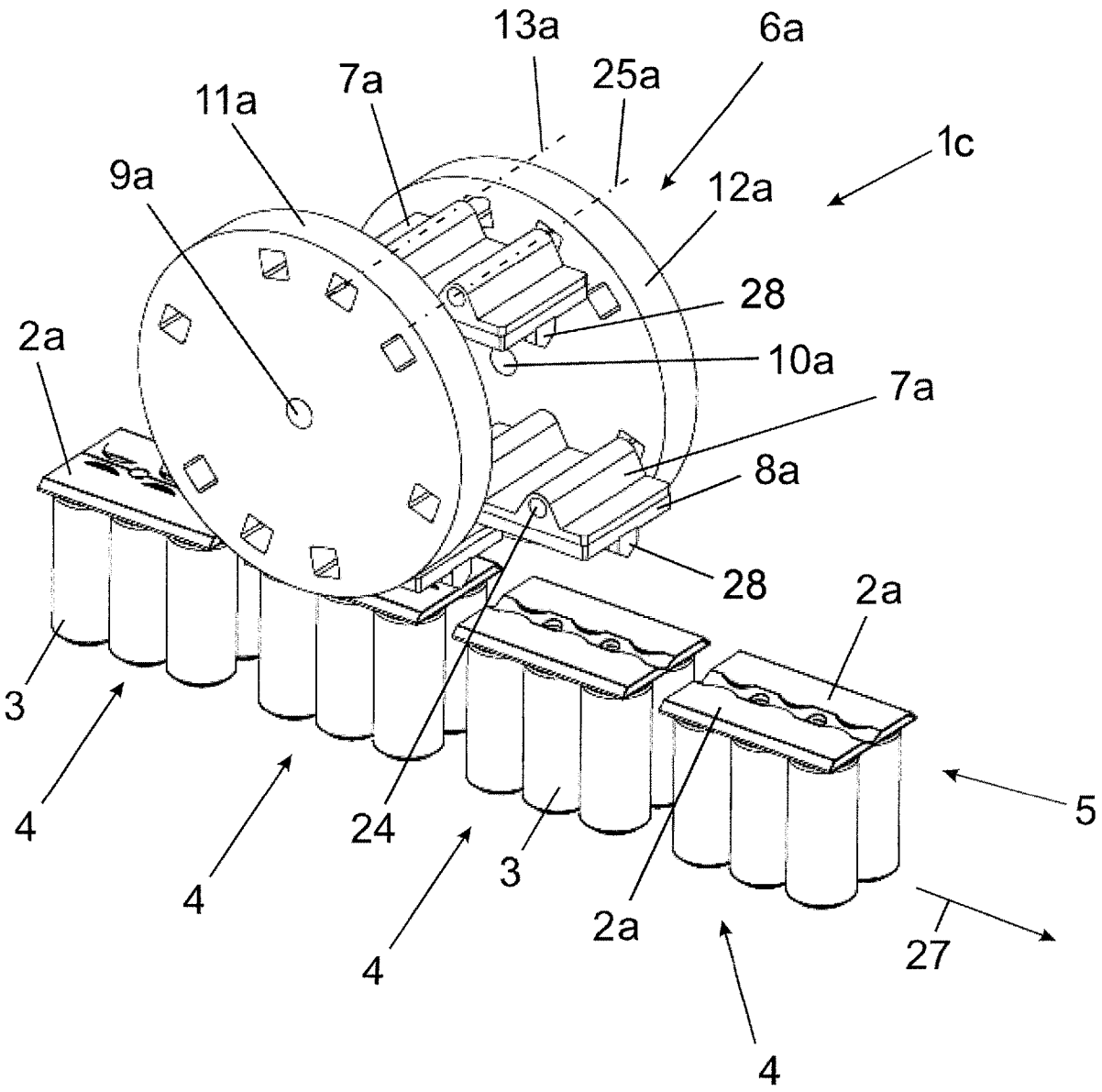
FIG. 6 a perspective view of a further application unit, downstream of the application unit from FIG. 5 in the transport direction, for locking the folding tabs.

FIG. 4 and FIG. 5 show the application unit 1*a* from FIG. 1 and FIG. 2 respectively, as well as several container groups 4 which are to be processed, assembled from containers 3, wherein the application unit 1*a*, however, is used to process another type of material blanks 2. In this present case, material blanks 2 are processed which in each case comprise two lateral folding tabs 2*a*. In the folded state (see FIG. 6), these serve as protection against dirt contamination for the covers of the containers 3.

With the aid of the application unit 1*a*, these material blanks 2 are applied in the manner described heretofore to the containers 3 of the respective container group 4. Following this, the lateral folding tabs 2*a* are folded with the aid of a folding device (not represented) downstream of the application unit 1*a* in the transport direction 27.

A further application unit 1*c* follows the said application unit 1*a* in the transport direction 27. This application 1*c* serves to lock the folded folding tabs 2*a* of a material blank 2 to one another.

The further application unit 1*c* is configured essentially identical in design to the first application unit 1*a*, but in each case additionally comprises at the tool plates 8*a* of its pressing elements a locking element 28. The respective locking element 28 has a shape tapering downwards to a point and extends preferably over the entire length of the associated tool plate 8*a*.

The container groups 4 are transported, with the folded material blanks 2 arranged on them, by means of the transport device along the transport direction 27 to the application unit 1*c*. By means of a drive of the application unit 1*c*, the first and second drive disks 11*a*, 12*a* are set in rotation about their first and second axes of rotation 9*a*, 10*a*, as a result of which the pressing elements 7*a*, with their tool plates 8*a* and the locking elements 28 arranged on them, circulate about the first and second axes of rotation 9*a*, 10*a*. In this situation the locking elements 28 come into engagement with the material blanks 2 and lock the two folding tabs 28 of the respective material blank 2 to one another.

REFERENCE NUMBER LIST

1*a*, 1*b*, 1*c* Application unit
2 Material blank
2*a* Folding tab
3 Container
4 Container group
5 Multipack
6*a*, 6*b* Drive unit
7*a*, 7*b* Pressing element
8*a*, 8*b* Tool plate
9*a*, 9*b* First axis of rotation
10*a*, 10*b* Second axis of rotation
11*a*, 11*b* First drive axle
12*a*, 12*b* Second drive axle
13*a*, 13*b* First articulated axle
14*a*, 14*b* Receiver opening
15 Drive motor
16 Power takeoff toothed wheel
17 Drive toothed wheel
18 Frame
19 Opening
20*a*, 29*b* First receiver opening group
21*a*, 21*b* Second receiver opening group
22 Screw
23 Hole
24 Jointed bolt
25*a*, 25*b* Second articulated axle
26 Square element
27 Transport direction
28 Locking element

The invention claimed is:

1. An application unit for a packaging machine for applying a material blank to containers assembled to form a container group, the application unit comprising:

at least one pressing element having a tool plate for connecting the material blank to containers of the container group to be conveyed along a transport plane; and a drive unit configured to move a pressing element to adjust the tool plate between an out-of-engagement position and an in-engagement position with the containers;

said drive unit including a first drive disk, being rotatable about a first axis of rotation, and a second drive disk, arranged parallel to and at a distance from said first drive disk, and being rotatable about a second axis of rotation, said first and second axes of rotation being aligned horizontally and at an equal height but not coaxially with one another; and said pressing element having first and second articulated axles, and said pressing element being connected by way of said first articulated axle in a jointed manner to said first drive disk and by way of said second articulated axle in a jointed manner to said second drive disk, so that, with a rotation of said first and second drive disks about said respective axes of rotation, said tool plate is aligned horizontally.

2. The application unit according to claim 1, wherein said pressing element is configured to render said tool plate detachable.

3. The application unit according to claim 1, wherein said first and second drive disks comprise receiver openings for a detachable arrangement of the articulated axles of said pressing elements.

4. The application unit according to claim 1, wherein each of said drive disks is formed with a plurality of receiver openings, which are arranged and distributed over their circumference, enabling a plurality of said pressing elements to be secured to said drive disks and being spaced from one another at distance intervals that are adjustable to different product divisions selected from the group consisting of 160 mm, 240 mm, and 320 mm.

5. The application unit according to claim 1, wherein each of said drive disks is formed with a plurality of receiver openings, which are arranged on a circular path with a predetermined circumference, and which are arranged in a first receiver opening group of n equidistant receiver openings, a second receiver opening group of n equidistant receiver openings, which are arranged opposite said receiver openings of said first receiver opening group, and two individual receiver openings, each arranged centrally between said first and second receiver opening groups on the circular path, wherein n is a natural number.

6. The application unit according to claim 5, wherein each of said drive disks is formed with at least eight receiver openings, the circular path has a circumference of 960 mm, and n is greater than or equal to 3.

7. The application unit according to claim 1, wherein said pressing element is one of a plurality of pressing elements, each having a first articulated axle connected to said first drive disk and second articulated axle connected to said second drive disk.

8. The application unit according to claim 7, wherein a number of said pressing elements is selected from the group consisting of 3, 4, and 6.

9. The application unit according to claim 7, wherein said plurality of pressing elements are arranged equidistantly from one another.

10. The application unit according to claim 1, wherein said drive unit comprises a drive motor for driving said drive disks.

11. The application unit according to claim 10, wherein said drive motor is an electric motor.

12. The application unit according to claim 10, wherein said drive disks comprise drive-toothed wheels configured to be brought into meshing engagement with power takeoff toothed wheels of said drive motor.

13. A packaging machine, comprising an application unit for applying a material blank to containers assembled to form a container group, the application unit including:

at least one pressing element having a tool plate for connecting the material blank to containers of the container group to be conveyed along a transport plane; and a drive unit configured to move a pressing element to adjust the tool plate between an out-of-engagement position and an in-engagement position with the containers;

said drive unit including a first drive disk, being rotatable about a first axis of rotation, and a second drive disk, arranged parallel to and at a distance from said first drive disk, and being rotatable about a second axis of rotation, said first and second axes of rotation being aligned horizontally and at an equal height but not coaxially with one another; and said pressing element having first and second articulated axles, and said pressing element being connected by way of said first articulated axle in a jointed manner to said first drive disk and by way of said second articulated axle in a jointed manner to said second drive disk, so that, with a rotation of said first and second drive disks about said respective axes of rotation, said tool plate is aligned horizontally.

14. The packaging machine according to claim 13, which comprises a transport device for conveying the containers in the transport direction along the transport plane, wherein the first and second axes of rotation are aligned perpendicular to the transport direction and at a same distance interval from the transport plane, and are arranged offset to one another in the transport direction.

15. The packaging machine according to claim 13, wherein said application unit is a first application unit and the packaging machine comprises a further application unit, wherein said first application unit is configured so as to apply a material blank to containers that are assembled into a container group, and said further application unit is configured to lock two lateral folding tabs of the material blank applied to the containers.

16. The packaging machine according to claim 13, further comprising a folding device arranged between said first application unit and said further application unit, for folding the lateral folding tabs of the material blank.

17. A method for operating an application unit or a packaging machine, the method comprising:

providing an application unit according to claim 1;

conveying the containers with a first product division;

subsequently changing the product division and conveying the containers with a second product division, which is different from the first product division; and regardless of the product division, using a fixed number of pressing elements and leaving a position of the pressing elements on the drive disks unchanged.

18. The method according to claim 17, wherein, with the respective predetermined product division, the circumferential speed of the pressing elements is variable.

* * * * *